US010158962B2

(12) United States Patent
Dausel

(10) Patent No.: US 10,158,962 B2
(45) **Date of Patent: *Dec. 18, 2018**

(54) METHOD FOR CONTROLLING A THREE-DIMENSIONAL MULTI-LAYER SPEAKER ARRANGEMENT AND APPARATUS FOR PLAYING BACK THREE-DIMENSIONAL SOUND IN AN AUDIENCE AREA

(71) Applicant: Barco NV, Kortrijk (BE)

(72) Inventor: Martin Dausel, Erfurt (DE)

(73) Assignee: Barco NV, Kortrijk (BE)

( * ) Notice: Subject to any disclaimer, the term of this patent is extended or adjusted under 35 U.S.C. 154(b) by 0 days.

This patent is subject to a terminal disclaimer.

(21) Appl. No.: 15/612,177

(22) Filed: Jun. 2, 2017

(65) Prior Publication Data

US 2017/0272888 A1 Sep. 21, 2017

Related U.S. Application Data

(63) Continuation of application No. 14/430,439, filed as application No. PCT/EP2012/068784 on Sep. 24, 2012, now Pat. No. 9,674,631.

(51) Int. Cl.
*H04R 5/00* (2006.01)
*H04S 7/00* (2006.01)
(Continued)

(52) U.S. Cl.
CPC ..... *H04S 7/302* (2013.01); *H04R 5/02* (2013.01); *H04S 7/30* (2013.01); *H04R 27/00* (2013.01);
(Continued)

(58) Field of Classification Search
CPC ..... H04R 5/02; H04R 2205/024; H04R 5/00; H04S 7/30; H04S 2400/11; H04S 2400/01
(Continued)

(56) References Cited

U.S. PATENT DOCUMENTS

2009/0034764 A1 2/2009 Ohashi
2009/0248425 A1* 10/2009 Vetterli ..... G10L 19/008 704/503
(Continued)

FOREIGN PATENT DOCUMENTS

WO 2011160850 A1 12/2011
WO 2013006330 A2 1/2013

OTHER PUBLICATIONS

Pulkii V; Virtual Sound Source Positioning Using Vector Base Amplitude Panning; J. Audio Engineering Society, NY; v.45, No. 6, 1996, pp. 456-466.

*Primary Examiner* — Alexander Jamal

(74) *Attorney, Agent, or Firm* — Harness, Dickey & Pierce, P.L.C.

(57) ABSTRACT

A method for controlling a three-dimensional multi-layer speaker arrangement having a plurality of speakers arranged in spaced layers. The method includes: providing information for a sound to be played back from a 3D source position assigned to the sound, wherein the source position is defined with respect to a reference point (RP) within the multi-layer speaker arrangement, extracting a 3D source position ($SP_{XY}$) from the source position and calculating layer specific speaker coefficients using a 2D calculator to position the sound two dimensional source position, and feeding a vertical pan or 3D source position into a multilayer calculator for obtaining a layer gain factor for each layer for obtaining speaker coefficients used as individual gains enabling the speakers to play back the sound.

13 Claims, 8 Drawing Sheets

Figure 1:
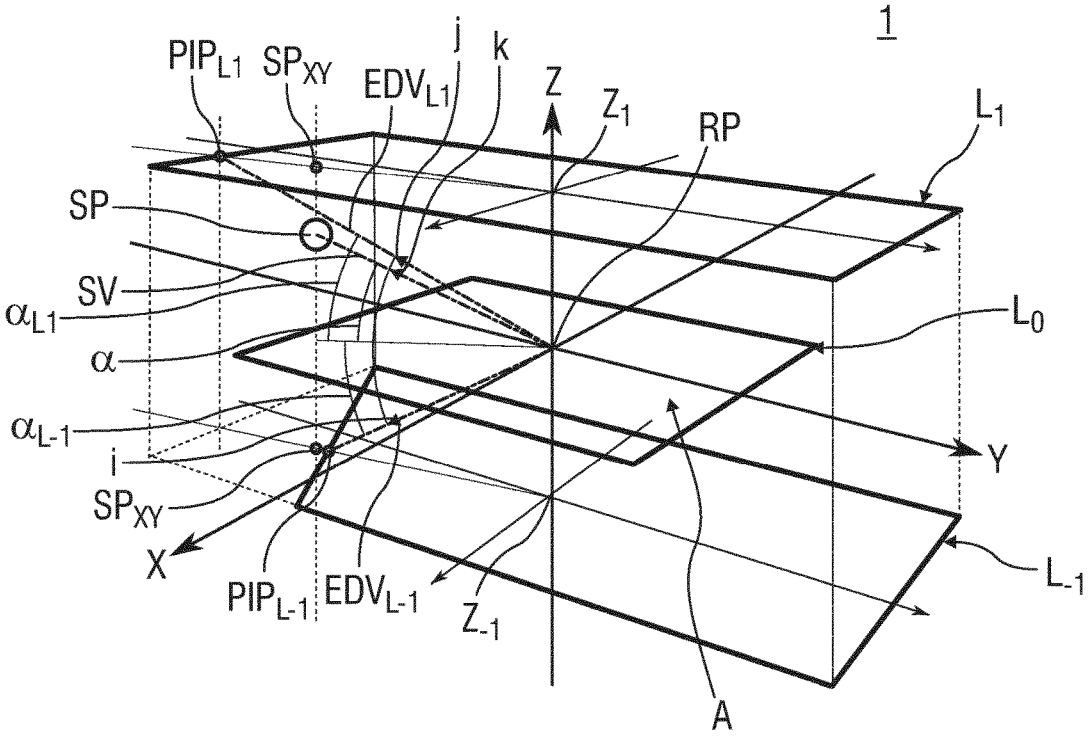

(51) Int. Cl.
*H04R 5/02* (2006.01)
*H04R 27/00* (2006.01)

(52) U.S. Cl.
CPC ..... *H04S 2400/11* (2013.01); *H04S 2420/13* (2013.01)

(58) Field of Classification Search
USPC ..... 381/300, 307, 310
See application file for complete search history.

(56) References Cited

U.S. PATENT DOCUMENTS

2010/0182231 A1* 7/2010 Morimiya ..... G06F 3/044 345/156
2015/0350804 A1* 12/2015 Crockett ..... H04R 5/02 381/307

* cited by examiner

METHOD FOR CONTROLLING A THREE-DIMENSIONAL MULTI-LAYER SPEAKER ARRANGEMENT AND APPARATUS FOR PLAYING BACK THREE-DIMENSIONAL SOUND IN AN AUDIENCE AREA

The invention relates to a method for controlling a three-dimensional multi-layer speaker arrangement and apparatus for playing back three-dimensional sound in an audience area.

WO 2011/160850 A1 discloses an apparatus for changing an audio scene comprising a direction determiner and an audio scene processing apparatus. The audio scene comprises at least one audio object comprising an audio signal and associated meta data. The direction determiner determines a direction of a position of the audio object with respect to a reference point based on the meta data of the audio object. Further, the audio scene processing device processes the audio signal, a processed audio signal derived from the audio signal or the meta data of the audio object based on a determined directional function and the determined direction of the position of the audio object.

It is an object of the present invention to provide an improved method for controlling a three-dimensional multi-layer speaker arrangement and an improved apparatus for playing back three-dimensional sound in an audience area.

The object is achieved by a method according to claim 1 and by an apparatus according to claim 13.

Advantageous embodiments of the invention are given in the dependent claims.

According to the invention a method is provided for controlling a three-dimensional multi-layer speaker arrangement comprising a plurality of speakers arranged in a number of speaker layers spaced from each other. According to the invention the method comprises:

- providing a sound information for a sound to be played back from a three dimensional source position assigned to the sound, wherein the source position is defined with respect to a reference point within the multi-layer speaker arrangement,
- extracting a two-dimensional source position from the source position and calculating layer specific speaker coefficients using a two-dimensional calculator in order to position the sound at the two-dimensional source position,
- feeding a vertical pan or the 3D source position into a multilayer calculator for obtaining a layer gain factor for each layer,
- multiplying the layer gain factors with the respective layer specific speaker coefficients for obtaining speaker coefficients used as individual gains for the speakers for playing back the sound.

Positioning the sound source is thus simplified by dividing the three dimensional calculation into a number of two dimensional calculations by the two-dimensional calculator and the multilayer calculator.

The two dimensional source position within the plane of the speaker layers may be obtained by projecting the source position into each speaker layer.

In an exemplary embodiment the speaker layers are arranged in parallel to each other and to an audience area. The calculation is thus simplified. However, non-parallel alignment of the speaker layers is possible.

In an exemplary embodiment the reference point is defined in the audience area, for example in a centre of the audience area. The audience area may thus be defined as a layer at approximately ear level of an audience.

In an exemplary embodiment the speakers within at least one of the speaker layers are arranged as a speaker polygon or layer envelope polygon. A speaker polygon is formed by arranging a number of speakers such that at least a subset of the speakers forms the vertices or corners of the polygon, which may be a rectangle, square, trapezoid, ring, star or which may have a different regular or irregular shape. A speaker polygon allows for arbitrarily defining the position of a sound source within the plane of the speaker polygon provided the shape or geometrical setup of the speakers in the speaker polygon is known to a control unit controlling the speakers for playing back the sound.

In an exemplary embodiment the two-dimensional calculator determines the layer specific speaker coefficients for the individual speakers taking into account a geometrical speaker setup in the respective speaker layer.

In an exemplary embodiment the multilayer calculator determines the layer gain factors taking into account the geometrical speaker setup in the respective speaker layer and the position of the speaker layers relative to each other and to the reference point.

In one embodiment of the method the vertical pan of the source position is provided in the first place thus defining a relative height of the source. In this case the absolute height of the source depends on the actual speaker setup. In another exemplary embodiment the multilayer calculator comprises a step, in which the three dimensional source position is used to calculate the vertical pan of the sound source taking into account the geometrical speaker setup in the respective speaker layer and the position of the speaker layers relative to each other and to the reference point. The subsequent steps of the method are thus simplified as they can be performed in the same way regardless of the input format of the source position.

In an exemplary embodiment at least one of the speaker layers comprises a speaker segment being an arrangement of speakers covering only a limited opening angle from the perspective of the reference point projected into the respective speaker layer. Such speaker segments occur in conventional multilayer speaker arrangements, e.g. in cinemas or home entertainment environments which typically have an array or speaker segment of lower front speakers at the bottom of a cinema screen. These speakers define a lower layer in the multilayer arrangement with a non closed speaker polygon or ring which may be referred to as the speaker segment. In order to localize a height of the sound source in such a setup is to use the speakers of a neighbouring layer which has speakers in the non covered angle range. For this purpose the multilayer calculator may comprise a step, in which a final vertical pan is set to a neighbouring speaker layer having a speaker polygon if the source position is outside the opening angle and outside an adjacent blend angle defined as the angle between the opening angle and the first speaker outside this opening angle in the neighbouring speaker layer, wherein the final vertical pan is blended between the layer with the speaker segment and the neighbouring speaker layer having the speaker polygon if the source position is within the blend angle, wherein step is skipped if the source position is within the opening angle. The final vertical pan is then used as the vertical pan in the subsequent calculations.

In an exemplary embodiment the multilayer calculator comprises a step with a layer gains mapper for calculating the layer gain factors ($G_{L1}$, $G_{L-1}$, $G_{L0}$), wherein a pair of neighbouring layers with a lower layer ($N_{LL}$) below and an upper layer ($N_{LU}$) above the source position (SP) is selected, wherein the vertical pan ($n_L$) is rounded if the source is positioned inside one of the speaker polygons, wherein a level ratio (r) is calculated by the equation $$r = \frac{n - N_{LL}}{N_{LU} - N_{LL}},$$

wherein the layer gains ($g_l$, $g_u$) of the lower layer ($N_{LL}$) and the upper layer ($N_{LU}$) are calculated by the equations $g_u$=r and $g_l$=1−r, wherein the layer gains ($g_l$, $g_u$) are normalized by their power sum.

In an exemplary embodiment the layer at the level of the audience area is assigned a layer number with the value 0, wherein layers above the audience area are assigned increasing positive integer layer numbers and layers beneath the audience area are assigned decreasing negative integer layer numbers.

In an exemplary embodiment the two dimensional panning algorithm comprises Vector Base Amplitude Panning (VBAP) or wave field synthesis (WFS).

According to the invention an apparatus for playing back three-dimensional sound in an audience area comprises:

- a three-dimensional multi-layer speaker arrangement comprising a plurality of speakers arranged in a number of speaker layers spaced from each other, and
- a control unit for the multi-layer speaker arrangement, wherein the control unit is arranged to perform the method for controlling a three-dimensional multi-layer speaker arrangement.

The Multilayer 3D algorithm is an approach to extend 2D specialized spatial audio algorithms to 3D by dividing a 3D speaker setup into horizontal layers of different heights. Every layer is calculated by a different instance of a suitable 2D algorithm. The resulting speaker coefficients of every layer are weighted by a layer gain factor calculated by the multilayer calculator. Additionally, 2D spatial audio algorithms (WFS, VBAP, . . . ) are modified so that they also take into account the height of the speakers of one layer. This is advisable to ensure time alignment and correct levelling between different layers.

The number of layers is not limited technically and depends on the application. E.g. for a dome in a planetarium the half sphere can be sliced in several speaker layers. The method is particularly suited but not limited to cinema environments with two or three layers.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 2:
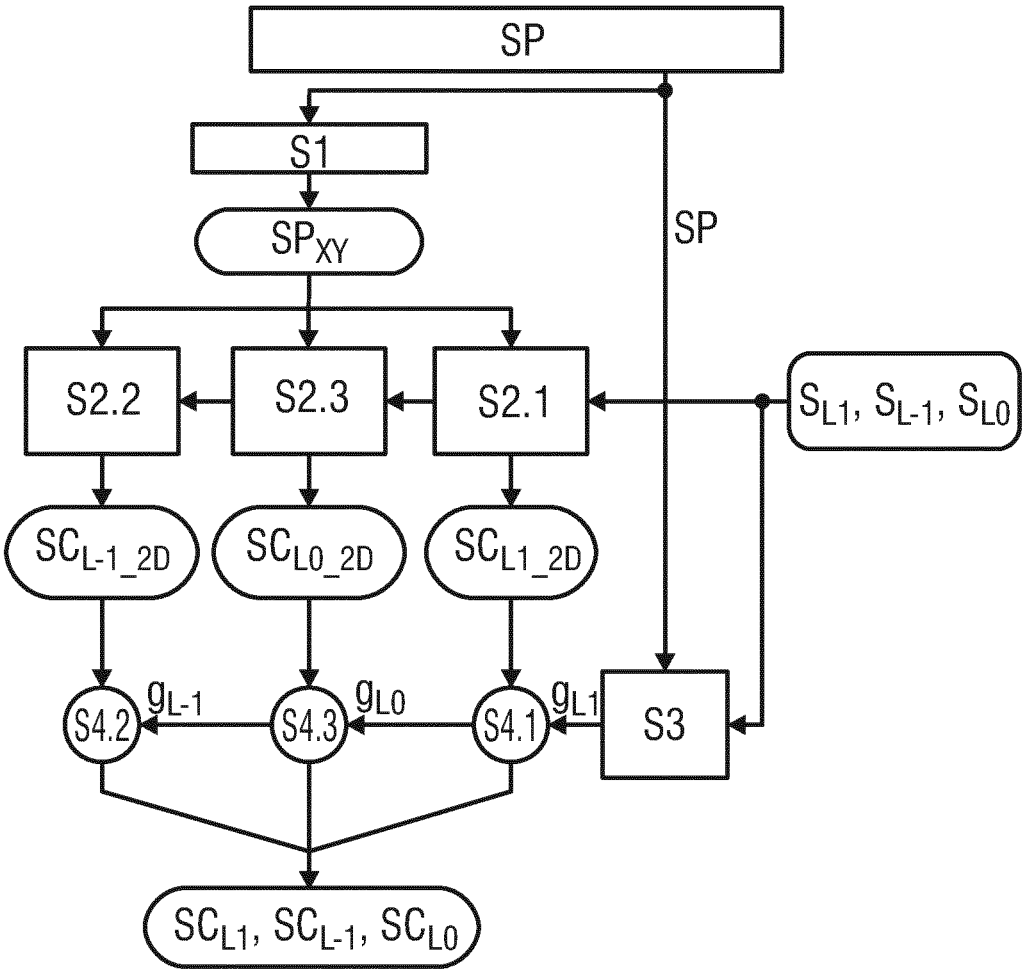
Figure 3:
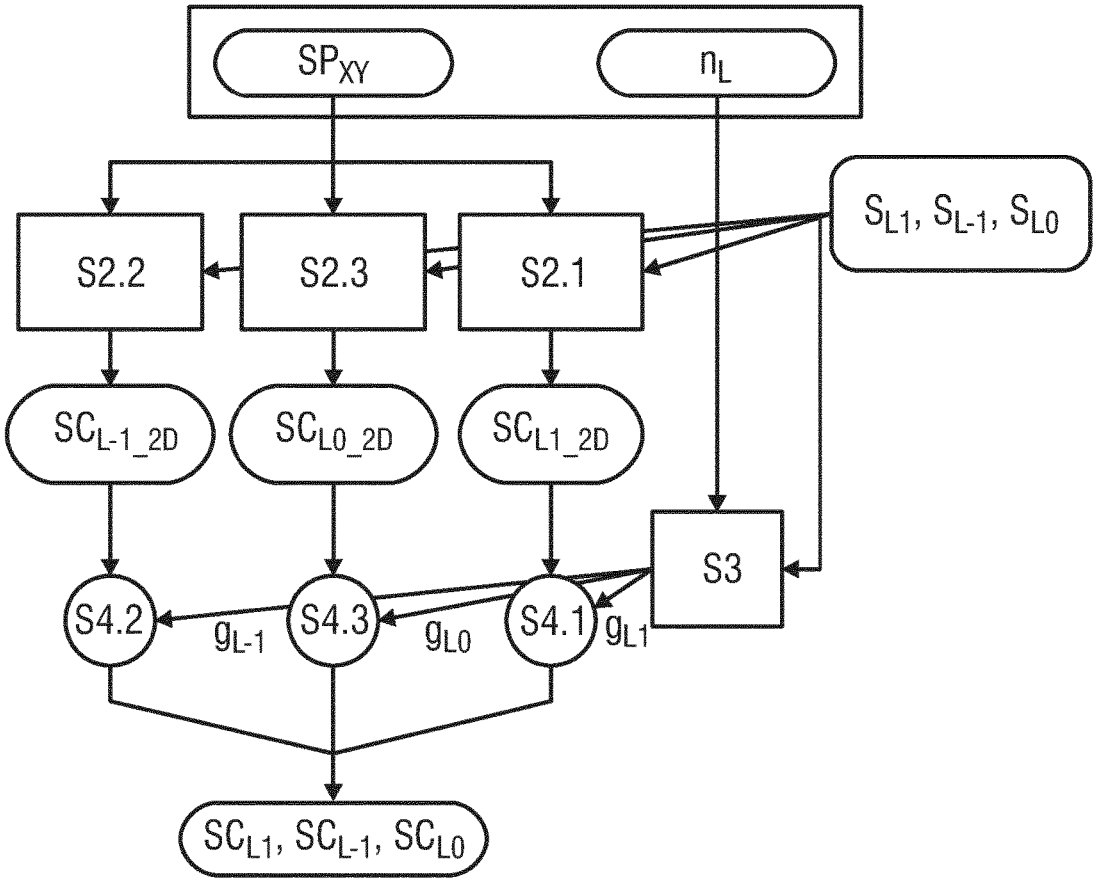
Figure 4:
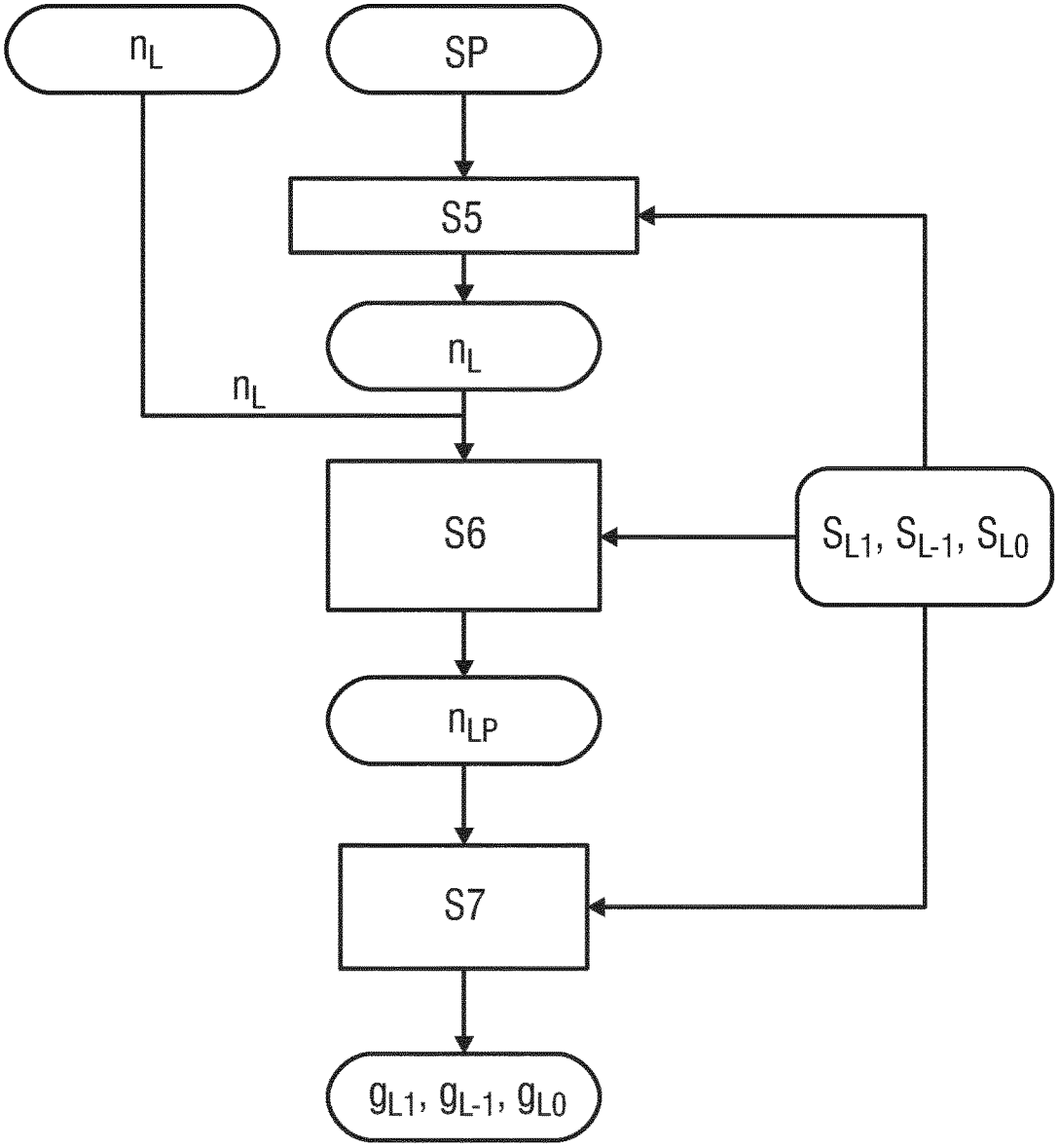
Figure 5:
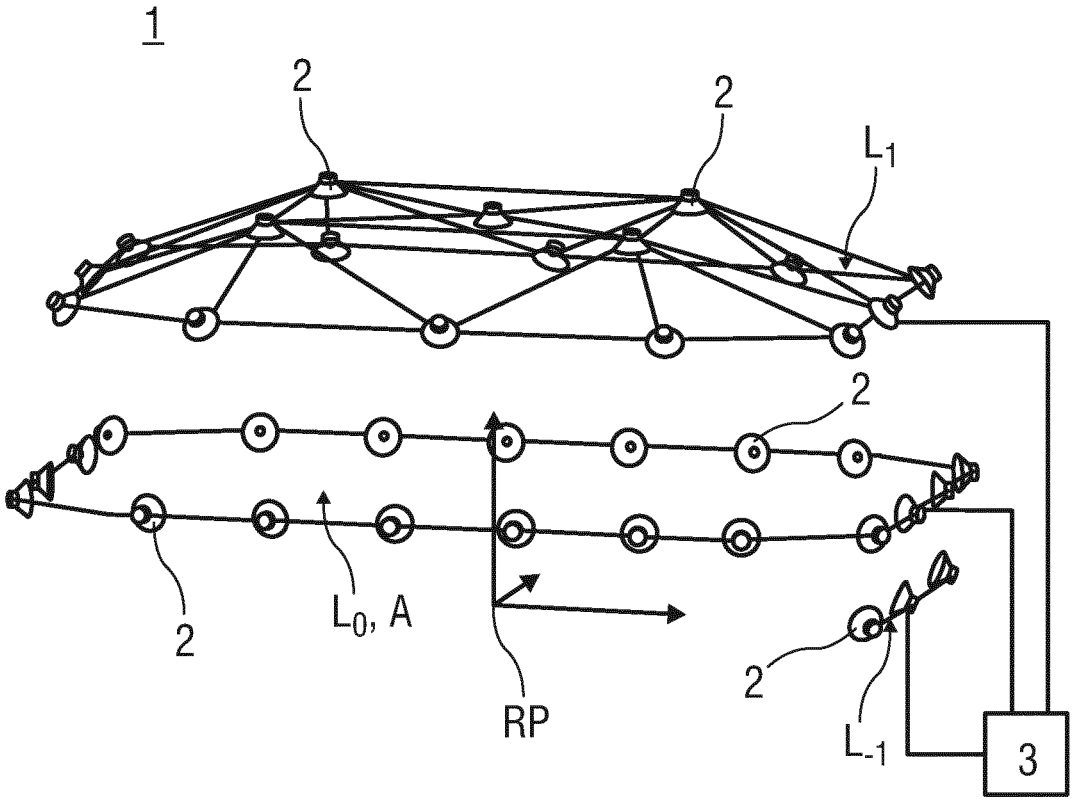
Figure 6:
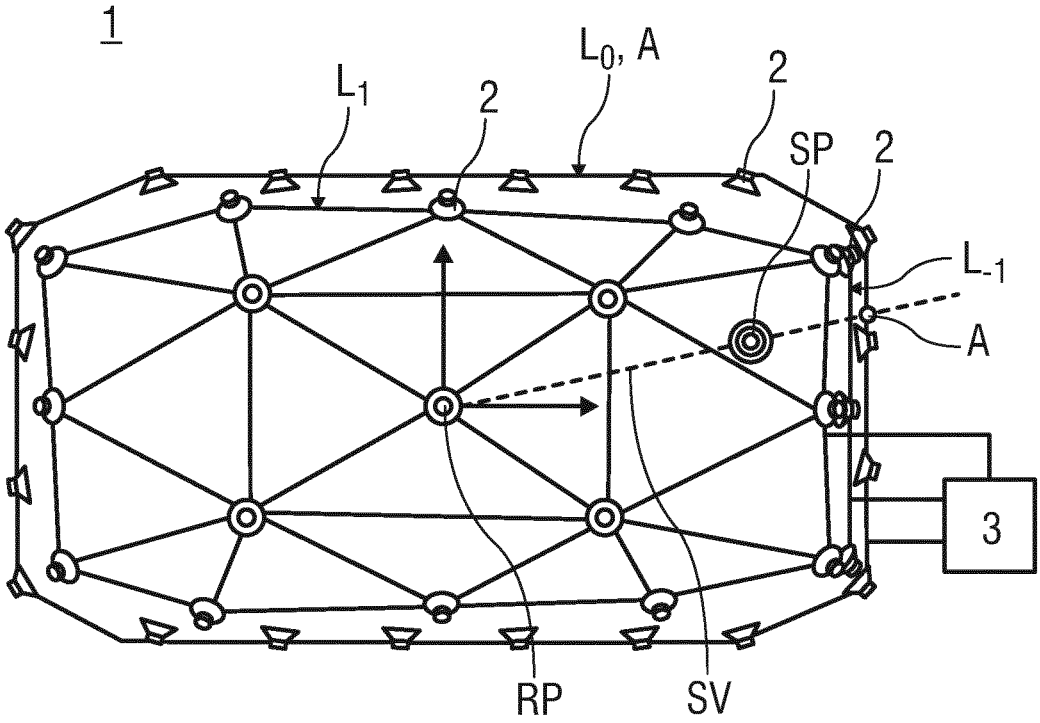
Figure 7:
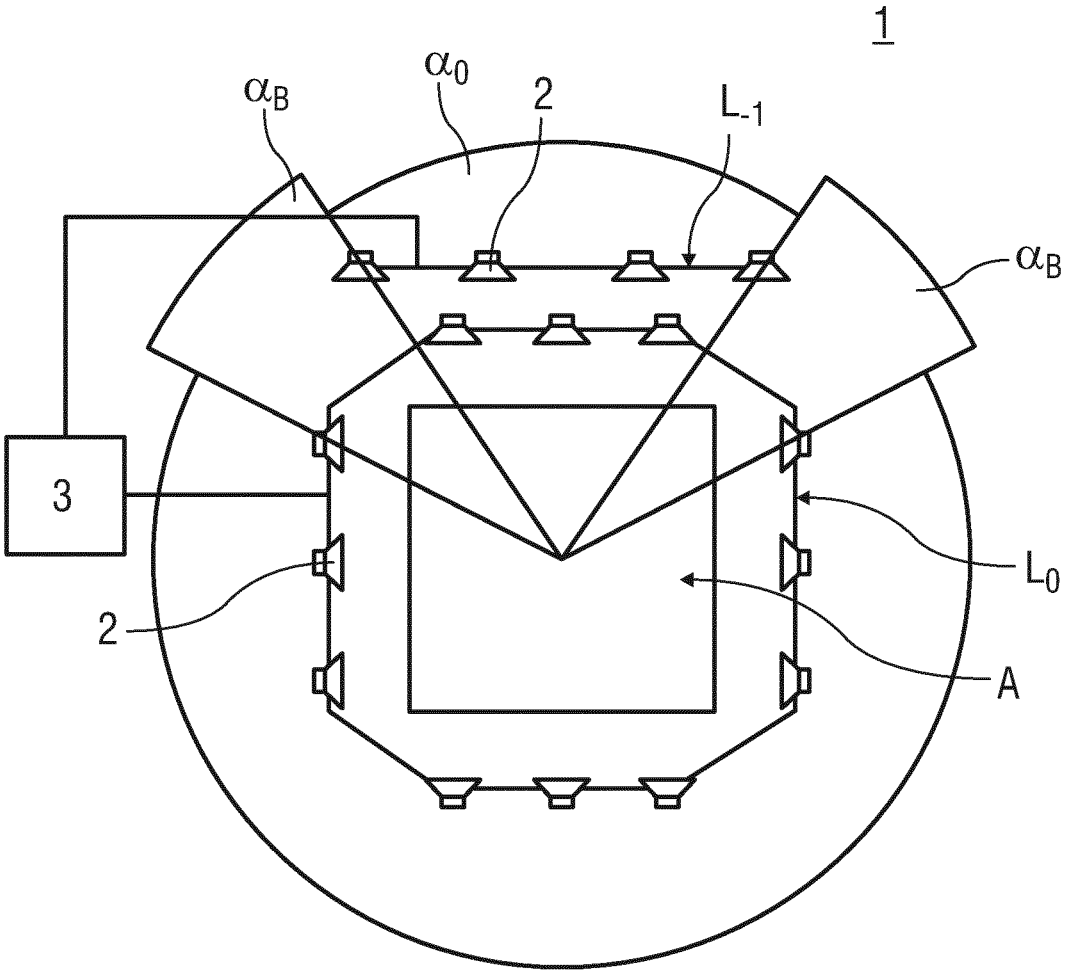
Figure 8:
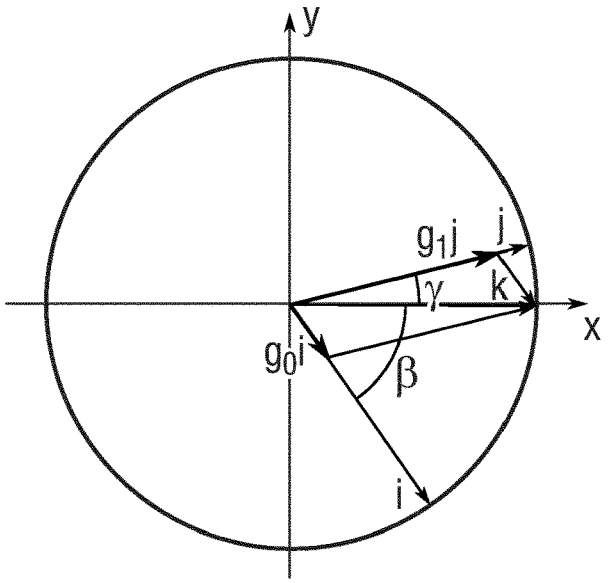
Figure 9:
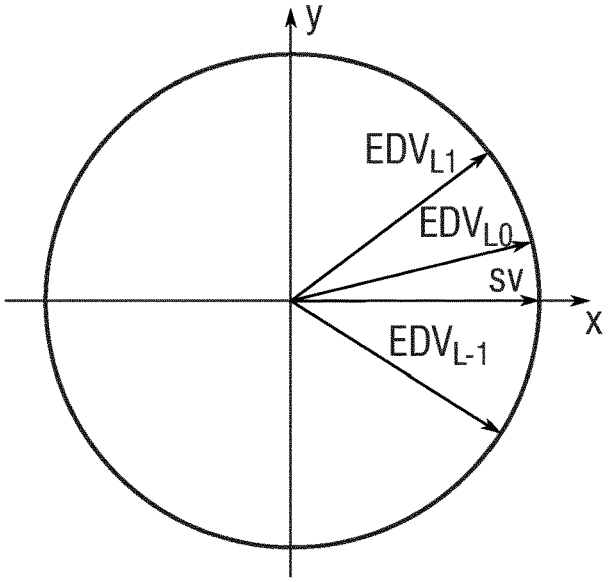

The present invention will become more fully understood from the detailed description given hereinbelow and the accompanying drawings which are given by way of illustration only, and thus, are not limitive of the present invention, and wherein:

FIG. 1 is a schematic view of a three dimensional multi-layer speaker arrangement with two speaker layers in a three dimensional space, FIG. 2 is a schematic block diagram of a first embodiment of a method for controlling the multi-layer speaker arrangement, FIG. 3 is a schematic block diagram of a second embodiment of a method for controlling the multi-layer speaker arrangement, FIG. 4 is a schematic block diagram of the multilayer calculator, FIG. 5 is a perspective view of a 3D multilayer speaker arrangement, FIG. 6 is a top view of the 3D multilayer speaker arrangement, FIG. 7 is another top view of the 3D multilayer speaker arrangement, FIG. 8 illustrates a 2D vector base gain factor calculation, and FIG. 9 illustrates the selection of the layer id part addressing a pair of neighbouring layers.

Corresponding parts are marked with the same reference symbols in all figures.

FIG. 1 is a schematic view of a three dimensional multi-layer speaker arrangement 1 with two speaker layers $L_1$ and $L_{-1}$ in a three dimensional space such as a room or a cinema. The speaker layer $L_1$ is arranged above an audience area A and therefore referred to as an upper layer $L_1$ with a layer number $N_L$=1. The speaker layer $L_{-1}$ is arranged below the audience area A and therefore referred to as a lower layer $L_{-1}$ with a layer number $N_L$=−1.

A sound is intended to be played back such that it appears to originate from a pre-determined point or position in the room referred to as a source position SP. The source position SP is defined with respect to a coordinate system having its reference point RP in the centre of the audience area A. The audience area A is considered a horizontal plane extending in the directions X and Y and having a height Z with the value 0. All points in the audience area A have an elevation angle with the value 0. The upper speaker layer $L_1$ is arranged as a speaker polygon in parallel above the audience area at a height $Z_1$. The lower speaker layer $L_{-1}$ is arranged as a lower speaker polygon in parallel beneath the audience area at a height $Z_{-1}$. In the embodiment illustrated the source position SP is located between the audience area A and the upper speaker layer $L_1$.

The boundaries of the speaker layers $L_1$ and $L_{-1}$ are defined by a speaker polygon formed by arranging a number of speakers 2 in the respective speaker layer $L_1$ and $L_{-1}$, wherein at least a subset of the speakers 2 are the vertices or corners of the polygon. In the illustrated embodiment the upper speaker layer $L_1$ is a rectangle while the lower speaker layer $L_{-1}$ is a trapezoid covering a smaller area than the upper speaker layer $L_1$. The illustrated shapes are given by way of example only. In alternative embodiments the speaker layers $L_1$, $L_{-1}$ may have different shapes.

In alternative embodiments the multi-layer speaker arrangement 1 may comprise more than two speaker layers $L_1$, $L_{-1}$. In particular it may comprise an additional speaker layer at the level of the audience area A.

FIG. 2 is a schematic block diagram of a first embodiment of a method for controlling the multi-layer speaker arrangement such that the sound appears to be played back from the pre-determined source position SP.

In the first embodiment the pre-determined source position SP is provided by a memory medium. In the memory medium, individual sounds or sound sequences are assigned to absolute three dimensional source positions SP or three dimensional source trajectories, i.e. sequences of source positions SP. Each three dimensional source position SP may be defined by Cartesian and/or spherical coordinates with respect to the reference point RP. For example, the source position SP may be defined by three values in the directions X, Y and Z. In another example, the three-dimensional source position SP may be defined by two Cartesian coordinates in the XY plane, i.e. the audience area A and a source elevation angle $\alpha$ above the audience area A. Likewise the three-dimensional source position SP may be defined by spherical coordinates comprising a radius, i.e. a distance between the source and the reference point RP, further comprising a source azimuth angle and a source elevation angle $\alpha$ above the audience area A.

In a step S1 of the method the sound source is projected into the two-dimensional XY plane, i.e. a source height value $SP_Z$ in the direction Z is removed from the source position SP. In the embodiment illustrated in FIG. 1 the projected source position $SP_{XY}$ is inside the upper speaker layer $L_1$ but outside the lower speaker layer $L_{-1}$. In steps S2.1, S2.2 the projected two dimensional source position $SP_{XY}$ is fed into respective 2D calculators for the speaker layers $L_1$, $L_{-1}$. Taking into account the geometrical speaker setup $S_{L1}$, $S_{L-1}$ in the respective speaker layer $L_1$, $L_{-1}$ the 2D calculator determines layer specific speaker coefficients $SC_{L1_2D}$, $SC_{L-1_2D}$ for the individual speakers 2 within the speaker layer $L_1$, $L_{-1}$ in order to virtually play the sound back from the respective projected two dimensional source position $SP_{XY}$. In a step S3 the source position SP is fed into a multilayer calculator whose details are illustrated in FIG. 4. Taking into account the geometrical speaker setup $S_{L1}$, $S_{L-1}$ in the respective speaker layer $L_1$, $L_{-1}$ and the position of the speaker layers $L_1$, $L_{-1}$ relative to each other and to the reference point RP the multilayer calculator determines layer gain factors $g_{L1}$, $g_{L-1}$ for each speaker layer $L_1$, $L_{-1}$. In steps S4.1, S4.2 the layer specific speaker coefficients $SC_{L1_2D}$, $SC_{L-1_2D}$ are multiplied by the respective layer gain factors $g_{L1}$, $g_{L-1}$ resulting in speaker coefficients $SC_{L1}$, $SC_{L-1}$, i.e. the individual gain used for each speaker 2 in order to make the sound source appear to be played back from the source position SP.

The method illustrated in FIG. 2 may be expanded to more than two speaker layers $L_1$, $L_{-1}$ by adding respective branches in parallel to the branches consisting of the steps S2.1, S4.1 and S2.2, S4.2. For example a branch with steps S2.3 and S4.3 for a speaker layer $L_0$ with a speaker polygon arranged at the level of the audience area A may be additionally provided.

FIG. 3 is a schematic block diagram of a second embodiment of a method for controlling the multi-layer speaker arrangement 1 such that the sound appears to be played back from the pre-determined source position SP.

As in the first embodiment the pre-determined source position SP is provided by a memory medium. In the memory medium, individual sounds or sound sequences are assigned to relative three dimensional source positions SP or relative three dimensional source trajectories, i.e. sequences of source positions SP. Each source position SP is defined by two-dimensional Cartesian and/or polar coordinates with respect to the reference point RP within the XY-plane. A relative position of the source in the Z direction is referred to as the vertical pan $n_L$, which relates to the speaker layer numbers $N_L$. For example, a vertical pan $n_L$ of 0.8 would represent a relative height of the source at 80% of the height of the speaker layer $L_1$ above the audience area A or the layer $L_0$, respectively. The vertical position of the source in this embodiment therefore depends on the actual speaker setup $S_{L1}$, $S_{L-1}$, $S_{L0}$ of the speaker layers $L_1$, $L_{-1}$, $L_0$.

In steps S2.1, S2.2 the two dimensional source position $SP_{XY}$ is fed into respective 2D calculators for the speaker layers $L_1$, $L_{-1}$. Taking into account the geometrical speaker setup $S_{L1}$, $S_{L-1}$ in the respective speaker layer $L_1$, $L_{-1}$ the 2D calculator determines layer specific speaker coefficients $SC_{L1_2D}$, $SC_{L-1_2D}$ for the individual speakers 2 within the speaker layer $L_1$, $L_{-1}$ in order to virtually play the sound back from the respective projected two dimensional source position $SP_{XY}$. In a step S3 the vertical pan $n_L$ of the source position SP is fed into a multilayer calculator whose details are illustrated in FIG. 4. Taking into account the geometrical speaker setup $S_{L1}$, $S_{L-1}$ in the respective speaker layer $L_1$, $L_{-1}$ the multilayer calculator determines layer gain factors $g_{L1}$, $g_{L-1}$ for each speaker layer $L_1$, $L_{-1}$. In steps S4.1, S4.2 the layer specific speaker coefficients $SC_{L1_2D}$, $SC_{L-1_2D}$ are multiplied by the respective layer gain factors $g_{L1}$, $g_{L-1}$ resulting in speaker coefficients $SC_{L1}$, $SC_{L-1}$, i.e. the individual gain used for each speaker 2 in order to make the sound source appear to be played back from the source position SP.

The method illustrated in FIG. 3 may be expanded to more than two speaker layers $L_1$, $L_{-1}$ by adding respective branches in parallel to the branches consisting of the steps S2.1, S4.1 and S2.2, S4.2. For example a branch with steps S2.3 and S4.3 for a speaker layer $L_0$ with a speaker polygon arranged at the level of the audience area A may be additionally provided.

FIG. 4 is a schematic block diagram of the multilayer calculator used in step S3 of the methods according to FIGS. 2 and 3.

If the multilayer calculator is called from the method according to the first embodiment (cf. FIG. 2) it is fed the three dimensional source position SP. Taking into account the geometrical speaker setup $S_{L1}$, $S_{L-1}$ in the respective speaker layer $L_1$, $L_{-1}$ and the position of the speaker layers $L_1$, $L_{-1}$ relative to each other and to the reference point RP in a step S5 the three dimensional source position SP is used to calculate the vertical pan $n_L$ of the sound source.

In step S5 the layer elevation angle $\alpha_{L1}$, $\alpha_{L-1}$ for every speaker layer $L_1$, $L_{-1}$ in relation to the source elevation angle $\alpha$ is calculated. These layer elevation angles $\alpha_{L1}$, $\alpha_{L-1}$ depend on the source position SP. Based on the differences between these layers elevation angles $\alpha_{L1}$, $\alpha_{L-1}$ and the source elevation angle $\alpha$ which all are lined up in a 2D plane the layer gain factors $g_{L1}$, $g_{L-1}$ can be calculated by using an algorithm similar to a 2D panning algorithm, e.g. VBAP.

The layer gain factors $g_{L0}$, $g_{L1}$, $g_{L-1}$ are a function of the respective layer elevation angles $\alpha_{L0}$, $\alpha_{L1}$, $\alpha_{L-1}$ or a function of the angles $\beta$ and $\gamma$, wherein $\beta$ is the difference angle between $\alpha_{L-1}$ and $\alpha$ and wherein $\gamma$ is the difference angle between $\alpha_{L1}$ and $\alpha$. Vectors i, j and k are unit length vectors representing the elevation of the lower speaker layer $L_{-1}$, the upper speaker layer $L_1$ and the source position SP. By using the angles $\beta$ and $\gamma$ to construct the vectors i, j and k in the 2D plane, a vector based approach similar to VBAP 2D can be used to calculate the layer gain factors or alternatively the ratio part of the vertical pan value as detailed below.

FIG. 8 illustrates the 2D vector base gain factor calculation. The two unit length vectors i and j form a vector base and the unit length vector k of the source can be expressed as linear combination of vectors i and j. The layer gain factors $g_{L0}$ and $g_{L1}$ of two exemplary neighbouring layers $L_0$, $L_1$ are obtained by the equation (1):

$$k=g_{L0}i+g_{L1}j \tag{1}$$

The equation may likewise be performed for other pairs of neighbouring layers. For additional operations it is advantageous to have one value expressing the ratio r between the two layer gain factors $g_{L0}$, $g_{L1}$. The ratio r is the fractional part of the vertical pan. The relation between the ratio r and the layer gain factors $g_{L0}$, $g_{L1}$ is shown in equations (3), (4), (5) and (6).

$$g_{L0} = 1 - r \tag{3}$$

$$g_{L1} = r \tag{4}$$

$$r = \frac{g_{L1}}{g_{L0} + g_{L1}} \tag{5}$$

$$1 - r = \frac{g_{L0}}{g_{L0} + g_{L1}} \tag{6}$$

When using more than two speaker layers, an integer value, which addresses a pair of neighbouring layers, may be used in addition to the gain ratio r. For this purpose the layers are assigned consecutive numbers. For the vertical pan the layer address and the ratio r can be expressed by one real number whose integer part is the layer number $N_L$ and whose fractional part is the gain ratio r. This kind of representation leads to the vertical pan value described in the following.

The layer number $N_L$ part of the vertical pan value is determined by finding the 2D transformed layer pair vectors which enclose the source vector SV.

FIG. 9 illustrates the selection of the layer id part addressing a pair of neighbouring layers. In this example, the source vector SV is located between the elevation direction vectors $EDV_{L0}$ and $EDV_{L-1}$. Hence, the layer pair $L_0$ and $L_1$ will be selected. The resulting integer part of the vertical pan value will therefore be 0.

FIG. 1 shows the construction of the layer elevation angles $\alpha_{L1}$, $\alpha_{L-1}$ in detail. An auxiliary 2D plane is fit through the reference point RP and the source position SP such that the auxiliary 2D plane cuts the audience area A at right angles. The two positions, where the auxiliary 2D plane cuts the boundaries of the envelop polygons of the upper speaker layer $L_1$ and the lower speaker layer $L_{-1}$ are defined as panning intersection points $PIP_{L1}$, $PIP_{L-1}$. This intersection operation may be calculated in the 2D space of the layer. The 2D panning intersection point $PIP_{L1}$, $PIP_{L-1}$ may then be transformed back to 3D.

A respective line from the reference point RP to the panning intersection point $PIP_{L1}$, $PIP_{L-1}$ is referred to as the elevation direction vector $EDV_{L1}$ $EDV_{L-1}$ for the respective speaker layer $L_1$, $L_{-1}$. A line from the reference point RP to the source position SP is referred to as the source vector SV. All elevation direction vectors $EDV_{L1}$ $EDV_{L-1}$ and the source vector SV are coplanar within the auxiliary 2D plane. The elevation direction vectors $EDV_{L1}$ $EDV_{L-1}$ and the source vector SV can be transformed to 2D within the auxiliary 2D plane and then be fed into a 2D calculator which returns the layer gain factors $g_{L1}$, $g_{L-1}$ to be used in the method in order to properly localize the 3D source. The 2D calculator may for example be a VBAP calculator as disclosed in V. Pulkki, *Virtual Sound Source Positioning Using Vector Base Amplitude Panning*, J. Audio Eng. Soc., Vol. 45, pp. 456-466, No. 6, 1997 June. In another embodiment the 2D calculator may be a WFS calculator.

If the multilayer calculator is called from the method according to the second embodiment (cf. FIG. 3) step S5 is skipped as the vertical pan $n_L$ of the sound source is provided in the first place.

Step S6 is an optional step which is performed in case one of the speaker layers $L_1$, $L_{-1}$, $L_0$ comprises a speaker segment instead of a speaker polygon, a speaker segment being an arrangement of speakers 2 covering only a limited angle when seen from the reference point or from the Z axis of the coordinate system. In the step S6 taking into account the geometrical speaker setup $S_{L1}$, $S_{L-1}$ in the respective speaker layer $L_1$, $L_{-1}$ and the position of the speaker layers $L_1$, $L_{-1}$ relative to each other and to the reference point RP the vertical pan $n_L$ is manipulated so as to determine a final vertical pan $n_{Lf}$. Conventional multilayer speaker arrangements 1 typically have an array or speaker segment of lower front speakers 2 at the bottom of a cinema screen. These speakers 2 define a lower layer $L_{-1}$ in the multilayer arrangement 1 with a non closed speaker polygon or ring which may be referred to as the speaker segment. The solution for such a situation is to use the speakers 2 of a neighbouring layer $L_0$ which has speakers 2 in the non covered angle range. Depending on the source azimuth angle the given vertical pan $n_L$ is manipulated to blend to the fully equipped neighbouring layer $L_0$ thereby obtaining the final vertical pan $n_{Lf}$. Blend angles $\alpha_B$ are defined as the angle between a lower speaker segment opening angle $\alpha_O$, i.e. an angle between two vectors obtained by connecting the reference point RP with the outermost speakers 2 of the speaker segment, and the first speaker outside of this opening angle in the neighbouring speaker layer $L_0$ (cf. FIG. 7).

If all speaker layers $L_1$, $L_{-1}$, $L_0$ comprise complete speaker polygons step S6 is skipped and the vertical pan $n_L$ is used as the final vertical pan $n_{Lf}$.

In a step S7 taking into account the geometrical speaker setup $S_{L1}$, $S_{L-1}$ in the respective speaker layer $L_1$, $L_{-1}$ and the position of the speaker layers $L_1$, $L_{-1}$ relative to each other and to the reference point RP the final vertical pan $n_{Lf}$ is fed into a layer gains mapper.

The vertical pan $n_L$ or final vertical pan $n_{Lf}$ directly maps to the layer gain factors $g_{L1}$, $g_{L-1}$. For this, every speaker layer $L_1$, $L_{-1}$, e.g. every speaker polygon has a layer number $N_L$ assigned. When creating the speaker setup, the speaker layers are assigned layer numbers $N_L$. A main layer $L_0$, which is typically the nearest layer to the ear level, i.e. the audience area A, has number 0, layers above have positive numbers (1, 2, . . . ), lower layers have negative numbers (−1, −2, . . . ).

In the cinema case speakers near ear level may be assigned the layer number $N_L$=0, speakers above a screen or on a ceiling are assigned the layer number $N_L$=1 and speakers below ear level, e.g. at the lower edge of the screen are assigned layer number $N_L$=−1.

In cases with speakers above and below ear level only, no speakers are assigned layer number $N_L$=0.

Sources are assigned 2D coordinates $SP_{XY}$ and a vertical pan or blend value $n_L$. Sources outside of all speaker envelop polygons can be panned to every layer $L_1$, $L_{-1}$, $L_0$ and between them. For sources inside at least one of the speaker envelop polygons the vertical pan value is rounded to an integer value so that there is no blending but only switching between the layers $L_1$, $L_{-1}$, $L_0$ because blending between layers $L_1$, $L_{-1}$, $L_0$ may produce unpleasant sound if one of the layers $L_1$, $L_{-1}$, $L_0$ renders a focussed source (Source position inside a layer envelope polygon means focussing if the layer algorithm is WFS).

Before calculating the layer gain factors the vertical pan value n is rounded if the source is inside one of the layer envelope polygons:

$$n = \text{round}(n) \tag{7}$$

Then a pair of neighbouring speaker layers $L_{-1}$, $L_0$, $L_1$ with one layer above and one layer below the source position SP is determined. The selected layer numbers $N_L$ may be referred to as $N_{LU}$ and $N_{LL}$.

For example there are three layers $L_{-1}$, $L_0$, $L_1$. The vertical pan value $n_L$ of the source is 0.3. Hence, the layer $L_0$ is the lower layer with layer number $N_{LL}$ and the layer $L_1$ is the upper layer with layer number $N_{LU}$. The layers $N_{LU}$ and $N_{LL}$ will be used for playing back the sound of the source.

In order to determine the layer gain factors $g_u$, $g_L$ of the layers $N_{LU}$ and $N_{LL}$ a layer ratio r is is calculated:

$$r = \frac{n - N_{LL}}{N_{LU} - N_{LL}} \tag{8}$$

With the ratio r the gains $g_u$, $g_l$ are calculated as follows:

$$g_u = r \tag{9}$$

$$g_l = 1 - r \tag{10}$$

To keep the perceived loudness constant the gains $g_u$, $g_l$ are normalized by their power sum:

$$g_{u_norm} = \frac{g_u}{\sqrt{g_u^2 + g_l^2}} \tag{11}$$

$$g_{l_norm} = \frac{g_l}{\sqrt{g_u^2 + g_l^2}} \tag{12}$$

The method for controlling the multi-layer speaker arrangement 1 fits well for speaker arrangements 1 where every layer is a complete polygon or ring of speakers 2. In this context, ring means that an angle between neighbouring speakers 2 is not larger than 120 degrees. In practice, there exist speaker arrangements 1 which don't meet this condition. For example one of the speaker layers $L_1$, $L_{-1}$, $L_0$ may comprise a speaker segment instead of a speaker polygon, a speaker segment being an arrangement of speakers 2 covering only a limited angle when seen from the reference point or from the Z axis of the coordinate system. In this case step S6 would be performed as described above.

FIGS. 5, 6 and 7 show a typical 3D multilayer speaker arrangement 1 as for example used in a cinema. The 3D multilayer speaker arrangement 1 comprises three layers $L_0$, $L_1$, $L_{-1}$, the main speaker polygon $L_0$ with layer number $N_L$=0 at ear level in the audience area A, ceiling speakers 2 in a laminar, grid-like arrangement in speaker layer $L_1$ and a lower front speaker segment forming the layer $L_{-1}$. The laminar, grid-like arrangement of speaker layer $L_1$ can be approximated so that it can be handled as a layer. In the approximation the z-components of the speaker coordinates are ignored, i.e. projected into an xy-plane along the z-axis, so that the resulting 2D speaker grid can then be controlled by a suitable 2D laminar panning algorithm, e.g. by triangulating the 2D grid (delaunay triangulation) and then panning between the three speakers surrounding the 2D source position using areal coordinates. FIG. 5 is a perspective view of the 3D multilayer speaker arrangement 1. FIG. 6 is a top view of the 3D multilayer speaker arrangement 1. FIG. 7 is a top view of the 3D multilayer speaker arrangement 1 without the level $L_1$.

LIST OF REFERENCES

1 multilayer speaker arrangement
2 speaker
3 control unit
A audience area
$\alpha$ source elevation angle
$\alpha_B$ blend angle
$\alpha_{L1}$ layer elevation angle
$\alpha_{L-1}$ layer elevation angle
$\alpha_O$ opening angle
$\beta$ difference angle
$\gamma$ difference angle
$EDV_{L1}$ elevation direction vector
$EDV_{L-1}$ elevation direction vector
$g_{L0}$ layer gain factor
$g_{L1}$ layer gain factor
$g_{L-1}$ layer gain factor
$g_L$ layer gain factor
$g_U$ layer gain factor
i, j, k unit length vector
$L_0$ speaker layer
$L_1$ speaker layer
$L_{-1}$ speaker layer
$n_L$, vertical pan
$n_{Lf}$ final vertical pan
$N_L$ layer number
$PIP_{L1}$ panning intersection point
$PIP_{L-1}$ panning intersection point
r ratio
RP reference point
$SC_{L1}$ speaker coefficient
$SC_{L-1}$ speaker coefficient
$SC_{L1_2D}$ layer specific speaker coefficient
$SC_{L-1_2D}$ layer specific speaker coefficient
$S_{L1}$ geometrical speaker setup
$S_{L-1}$ geometrical speaker setup
SP source position
$SP_X$ X component of source position
$SP_{XY}$ projected source position
$SP_Y$ Y component of source position
$SP_Z$ source height value
SV source vector
S1 step
S2.1 step
S2.2 step
S2.3 step
S3 step
S4.1 step
S4.2 step
S4.3 step
S5 step
S6 step
S7 step
X direction
Y direction
Z direction
$Z_1$ height

The invention claimed is:

1. A method for controlling a three-dimensional multilayer speaker arrangement comprising a plurality of speakers arranged in a number of speaker layers ($L_0$, $L_1$, $L_{-1}$) spaced from each other, the method comprising:

providing a sound information for a sound to be played back from a three dimensional source position (PS) assigned to the sound, wherein the source position (PS) is defined with respect to a reference point (RP) within the multi-layer speaker arrangement, extracting a two-dimensional source position ($SP_{XY}$) from the source position (SP) and calculating layer specific speaker coefficients ($SC_{L1_2D}$, $SC_{L-1_2D}$, $SC_{L0_2D}$)

using a two-dimensional calculator in order to position the sound at the two-dimensional source position ($SP_{XY}$), feeding a vertical pan ($n_L$) or the 3D source position (SP) into a multilayer calculator for obtaining a layer gain factor ($g_{L0}$, $g_{L1}$, $g_{L-1}$) for each layer ($L_0$, $L_1$, $L_{-1}$), multiplying the layer gain factors ($g_{L0}$, $g_{L1}$, $g_{L-1}$) with the respective layer specific speaker coefficients ($SC_{L1_2D}$, $SC_{L-1_2D}$, $SC_{L0_2D}$) for obtaining speaker coefficients ($SC_{L1}$, $SC_{L-1}$, $SC_{L0}$) used as individual gains for the speakers for playing back the sound.

2. The method according to claim 1, wherein the speaker layers ($L_0$, $L_1$, $L_{-1}$) are arranged in parallel to each other and to an audience area (A).

3. The method according to claim 2, wherein the reference point (RP) is inside the audience area (A).

4. The method according to claim 1, wherein the speakers within at least one of the speaker layers ($L_0$, $L_1$, $L_{-1}$) are arranged as a speaker polygon.

5. The method according to claim 1, wherein the two-dimensional calculator determines the layer specific speaker coefficients ($SC_{L1_2D}$, $SC_{L-1_2D}$, $SC_{L0_2D}$) for the individual speakers (2) taking into account a geometrical speaker setup ($S_{L1}$, $S_{L-1}$, $S_{L0}$) in the respective speaker layer ($L_1$, $L_{-1}$, $S_{L0}$).

6. The method according to claim 1, wherein the multi-layer calculator determines the layer gain factors ($g_{L1}$, $g_{L-1}$, $g_{L0}$) taking into account the geometrical speaker setup ($S_{L1}$, $S_{L-1}$, $S_{L0}$) in the respective speaker layer ($L_1$, $L_{-1}$, $L_0$) and the position of the speaker layers ($L_1$, $L_{-1}$, $L_0$) relative to each other and to the reference point (RP).

7. The method according to claim 1, wherein the multi-layer calculator comprises a step (S5), in which the three dimensional source position (SP) is used to calculate the vertical pan ($n_L$) of the sound source taking into account the geometrical speaker setup ($S_{L1}$, $S_{L-1}$, $S_{L0}$) in the respective speaker layer ($L_1$, $L_{-1}$, $L_0$) and the position of the speaker layers ($L_1$, $L_{-1}$, $L_0$) relative to each other and to the reference point (RP).

8. The method according to claim 1, wherein at least one of the speaker layers ($L_1$, $L_{-1}$, $L_0$) comprises a speaker segment being an arrangement of speakers covering only a limited opening angle ($\alpha_O$) from the perspective of the reference point (RP) projected into the respective speaker layer ($L_1$, $L_{-1}$, $L_0$), wherein the multilayer calculator comprises a step (S6), in which a final vertical pan ($n_{Lf}$) is set to a neighbouring speaker layer ($L_1$, $L_{-1}$, $L_0$) having a speaker polygon if the source position (SP) is outside the opening angle ($\alpha_O$) and outside an adjacent blend angle ($\alpha_B$) defined as the angle between the opening angle ($\alpha_O$) and the first speaker outside this opening angle ($\alpha_O$) in the neighbouring speaker layer ($L_1$, $L_{-1}$, $L_0$), wherein the final vertical pan ($n_{Lf}$) is blended between the layer ($L_1$, $L_{-1}$, $L_0$) with the speaker segment and the neighbouring speaker layer ($L_1$, $L_{-1}$, $L_0$) having the speaker polygon if the source position (SP) is within the blend angle ($\alpha_B$), wherein step (S6) is skipped if the source position (SP) is within the opening angle ($\alpha_O$).

9. The method according to claim 1, wherein the multi-layer calculator comprises a step (S7) with a layer gains mapper for calculating the layer gain factors ($g_{L1}$, $g_{L-1}$, $g_{L0}$), wherein a pair of neighbouring layers with a lower layer ($N_{LL}$) below and an upper layer ($N_{LU}$) above the source position (SP) is selected, wherein the vertical pan ($n_L$) is rounded if the source is positioned inside one of the speaker polygons, wherein a level ratio (r) is calculated by the equation $$r = \frac{n - N_{LL}}{N_{LU} - N_{LL}},$$

wherein the layer gains ($g_l$ $g_u$) of the lower layer ($N_{LL}$) and the upper layer ($N_{LU}$) are calculated by the equations $g_u$=r and $g_l$=l−r, wherein the layer gains ($g_l$ $g_u$) are normalized by their power sum.

10. The method according to claim 9, wherein in step (S5) an auxiliary 2D plane is fit through the reference point (RP) and the source position (SP) such that the auxiliary 2D plane cuts the audience area (A) at right angles, wherein the two positions, where the auxiliary 2D plane cuts the boundaries of the speaker layers ($L_1$, $L_{-1}$) are defined as panning intersection points ($PIP_{L1}$, $PIP_{L-1}$), wherein elevation direction vectors ($EDV_{L1}$ $EDV_{L-1}$) for the respective speaker layer ($L_1$, $L_{-1}$) are constructed between the reference point (RP) and the panning intersection points ($PIP_{L1}$, $PIP_{L-1}$), wherein a source vector (SV) is constructed between the reference point (RP) and the source position (SP), wherein the elevation direction vectors ($EDV_{L1}$ $EDV_{L-1}$) and the source vector (SV) are fed into a 2D calculator for calculating the layer gain factors ($g_{L1}$, $g_{L-1}$).

11. The method according to claim 2, wherein the layer ($L_0$) which is nearest to the level of the audience area (A) is assigned a layer number ($N_L$) with the value 0, wherein layers ($L_1$) above this layer ($L_0$) are assigned increasing positive integer layer numbers ($N_L$) and layers ($L_1$) beneath this layer ($L_0$) are assigned decreasing negative integer layer numbers ($N_L$), wherein the layer gain factor ($g_L$) for a layer ($L_0$, $L_1$, $L_{-1}$) is calculated by subtracting the absolute value of the difference of the vertical pan ($n_L$) and the layer number ($N_L$) from 1 if the absolute value of the difference of the vertical pan ($n_L$) and the layer number ($N_L$) is at most 1, wherein the layer gain factor ($g_L$) is set to 0 otherwise.

12. The method according to claim 9, wherein the two dimensional panning algorithm in step (S5) comprises Vector Base Amplitude Panning.

13. An apparatus for playing back three-dimensional sound in an audience area, comprising:

three-dimensional multi-layer speaker arrangement comprising a plurality of speakers arranged in a number of speaker layers ($L_0$, $L_1$, $L_{-1}$) spaced from each other, said speaker arrangement providing a sound information for a sound to be played back from a three dimensional source position (PS) assigned to the sound, wherein the source position (PS) is defined with respect to a reference point (RP) within the multi-layer speaker arrangement, a control unit for the multi-layer speaker arrangement, wherein the control unit is arranged to extract a two-dimensional source position ($SP_{XY}$) from the source position (SP) and calculating layer specific speaker coefficients ($SC_{L1_2D}$, $SC_{L-1_2D}$, $SC_{L0_2D}$) using a two-dimensional calculator in order to position the sound at the two-dimensional source position ($SP_{XY}$), feed a vertical pan ($n_L$) or the 3D source position (SP) into a multilayer calculator for obtaining a layer gain factor ($g_{L0}$, $g_{L1}$, $g_{L-1}$) for each layer ($L_0$, $L_1$, $L_{-1}$), multiply the layer gain factors ($g_{L0}$, $g_{L1}$, $g_{L-1}$) with the respective layer specific speaker coefficients ($SC_{L1_2D}$, $SC_{L-1_2D}$, $SC_{L0_2D}$) for obtaining speaker coefficients ($SC_{L1}$, $SC_{L-1}$, $SC_{L0}$) used as individual gains for the speakers for playing back the sound.

* * * * *